US010358192B2

(12) United States Patent
Sitar

(10) Patent No.: US 10,358,192 B2
(45) Date of Patent: Jul. 23, 2019

(54) INFLATABLE WATERCRAFT WITH AN EMBEDDED DRIVE

(71) Applicant: 3S Sport D.O.O., Kamnik (SI)

(72) Inventor: Sebastjan Sitar, Stahovica (SI)

(73) Assignee: 3S Sport D.O.O., Kamnik (SI)

( * ) Notice: Subject to any disclaimer, the term of this patent is extended or adjusted under 35 U.S.C. 154(b) by 0 days.

(21) Appl. No.: 15/552,090

(22) PCT Filed: Dec. 15, 2015

(86) PCT No.: PCT/SI2015/000036
§ 371 (c)(1),
(2) Date: Aug. 18, 2017

(87) PCT Pub. No.: WO2016/099406
PCT Pub. Date: Jun. 23, 2016

(65) Prior Publication Data

US 2018/0065717 A1 Mar. 8, 2018

(30) Foreign Application Priority Data

Dec. 15, 2014 (SI) ..... 201400446

(51) Int. Cl.
*B63B 7/08* (2006.01)
*B63B 35/79* (2006.01)
(Continued)

(52) U.S. Cl.
CPC ..... *B63B 35/7913* (2013.01); *B63B 35/7943* (2013.01); *B63H 5/165* (2013.01);
(Continued)

(58) Field of Classification Search
CPC ..... B63B 2035/79; B63B 2035/7903; B63B 35/7913; B63B 35/7943; B63B 35/79; B63B 7/087
See application file for complete search history.

(56) References Cited

U.S. PATENT DOCUMENTS 1,512,391 A 10/1924 Abraham
3,158,882 A * 12/1964 Kibby ..... B63B 35/795 114/39.22
(Continued)

FOREIGN PATENT DOCUMENTS

DE 2155978 A1 * 5/1973 ..... B63B 35/7913
WO WO-2014164522 A1 * 10/2014 ..... B63H 23/24

*Primary Examiner* — Ajay Vasudeva
(74) *Attorney, Agent, or Firm* — Bay State IP, LLC

(57) ABSTRACT

The object of the invention is an inflatable watercraft (1) (SUP—stand up paddling) with an embedded drive and having a specially shaped recess in the center, preferably in the center of gravity of the watercraft (1), into which a housing (2, 2') of a drive assembly is inserted before the watercraft is filled with air. While the watercraft (1) is filled with air, the air pressure firmly fixes the housing (2, 2') of the drive assembly to a proper position. The housing (2, 2') accommodates the drive assembly that comprises a storage battery (4), an electric motor (5), a compressor (3) and an electronic circuit (8), wherein the drive assembly is provided with a flow-through channel (6), in which a drive screw (7) is arranged, and both the input and the output sides of the flow-through channel (6) are protected by grates.

11 Claims, 6 Drawing Sheets

Figure 1:
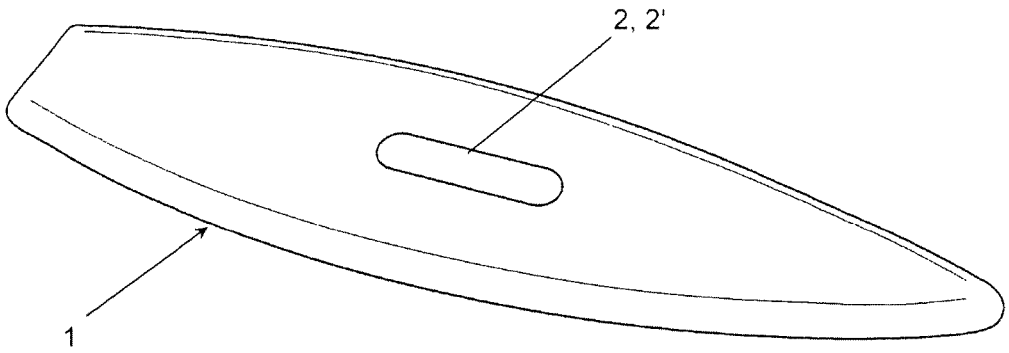

(51) Int. Cl.

| | |
|---|---|
| ***B63H 11/00*** | (2006.01) |
| ***B63H 5/16*** | (2006.01) |
| ***B63H 16/04*** | (2006.01) |
| *B63H 11/08* | (2006.01) |

(52) U.S. Cl.
CPC ..... *B63H 16/04* (2013.01); *B63B 7/087* (2013.01); *B63H 11/00* (2013.01); *B63H 11/08* (2013.01)

(56) References Cited

U.S. PATENT DOCUMENTS

| | | | | | |
|---|---|---|---|---|---|
| 3,763,817 | A * | 10/1973 | Francis | B63B 35/73 | 114/183 R |
| 4,911,094 | A * | 3/1990 | Akers | B63B 1/041 | 114/249 |
| 5,081,947 | A * | 1/1992 | Holden | B63B 7/082 | 114/345 |
| 5,105,753 | A * | 4/1992 | Chih | A63B 35/12 | 114/315 |
| 6,966,808 | B1 | 11/2005 | Liao | | |
| 7,930,985 | B2 * | 4/2011 | Walworth | B63B 35/73 | 114/55.58 |
| 8,047,886 | B1 * | 11/2011 | McLarty | B63B 7/06 | 114/346 |
| 8,306,673 | B1 | 11/2012 | Manning | | |
| 8,851,947 | B2 * | 10/2014 | Vlock | B63B 7/085 | 441/74 |
| 2011/0212691 | A1 * | 9/2011 | Rott | H04B 1/3827 | 455/41.3 |
| 2013/0335205 | A1 | 12/2013 | Willner | | |

* cited by examiner

INFLATABLE WATERCRAFT WITH AN EMBEDDED DRIVE

The object of the invention is an inflatable watercraft (SUP—stand up paddling) with an embedded drive and having a specially shaped recess in the centre, preferably in the centre of gravity, into which a housing of a drive assembly is inserted before the watercraft is filled with air. While the watercraft is filled with air, the air pressure firmly fixes the housing of the drive assembly to a proper position. The drive assembly is operated by an operating device embedded into an oar, with which the watercraft is operated. The operating device of the watercraft is formed as an interface inserted between a shaft and a handle of the oar and is connected wirelessly with electronics in the drive assembly. The invention belongs to Class B63B 35/97 of the International Patent Classification.

The technical problem that is successfully solved by the present invention is a configuration and embodiment of such inflatable watercraft—SUP intended for cruising in still waters, into which a drive assembly will be inserted in a simple way and without any additional tool, and the assembly will provide for movement of the inflatable watercraft, while the inserted drive assembly will not change characteristics and floating properties of the watercraft itself such that the inflatable watercraft can be used even without the operation of the drive assembly. The drive of the inflatable watercraft is primarily meant as additional help to an oarsman and not as a substitute for oaring.

There are known embodiments of inflatable watercrafts SUP that can have embedded drive assemblies. The latter are subsequently added to a watercraft and therefore change floating properties of the watercraft itself; they are most frequently embedded in the rear half of the watercraft. Such watercrafts are intended for a more rapid movement especially on waves.

Additionally to said known embodiments, there is also a known configuration of a watercraft according to patent document WO2012/003333, wherein the watercraft is provided in its rear half with a recess, into which a large-dimension cassette can be inserted that serves as a storage space or can accommodate a driving part.

Patent document WO2014/164522 describes an embodiment of an inflatable watercraft, into which a bodyboard is inserted in the rear half of the body. The drive is disposed in the rear part mostly due to the way of use of the inflatable watercraft of this type (surfing on a wave), whereas the inflatable watercraft of the invention is used predominantly in still waters.

The inflatable watercraft with the embedded drive of the invention accommodates within a housing of a drive assembly that tightly fits a recess in the center of gravity of the watercraft a storage battery, an electric motor, a system for inflating the watercraft, and a control electronic circuit that allows creating a wireless connection with an oar, operates the motor both in inflation mode and in the drive operation mode during cruising, and controls the status of the storage battery while in use and during charging of the battery.

Figure 2:
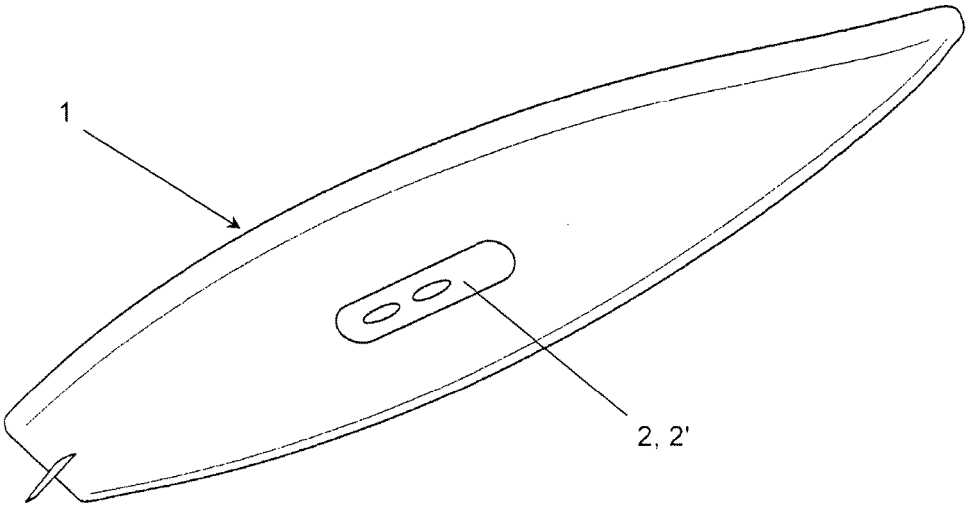
Figure 3:
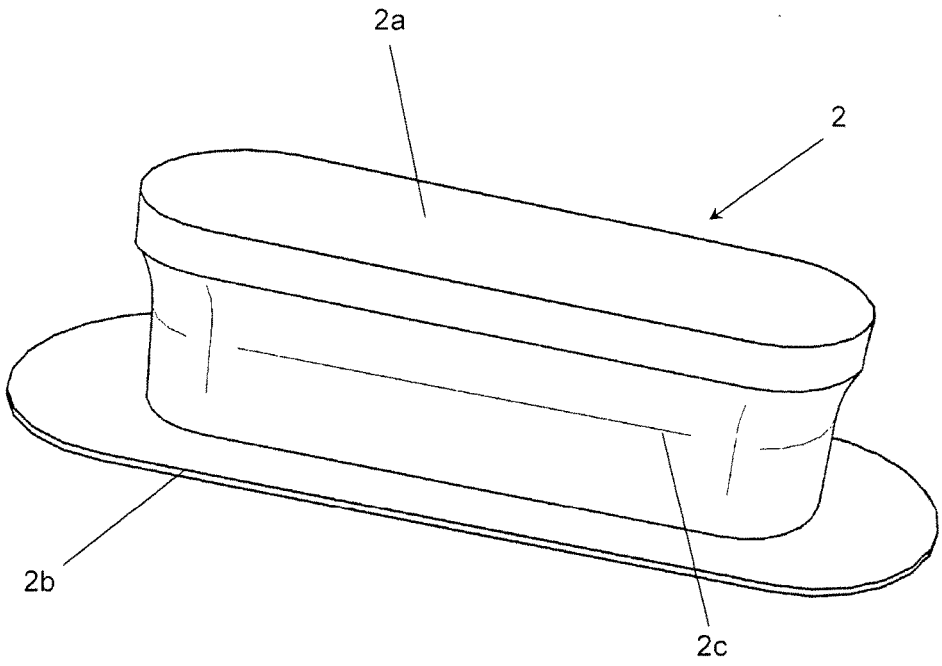
Figure 4:
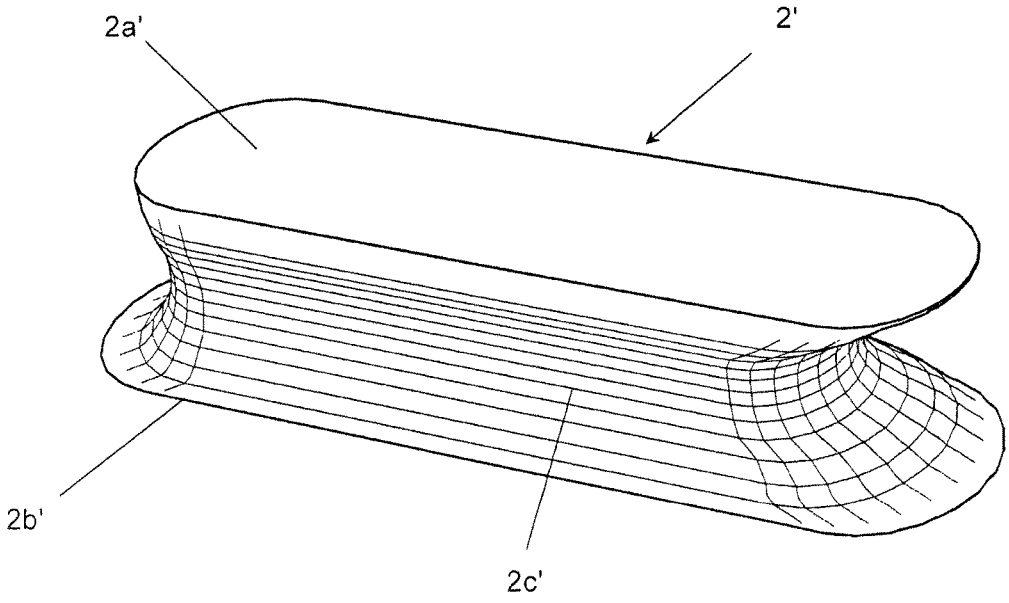
Figure 5:
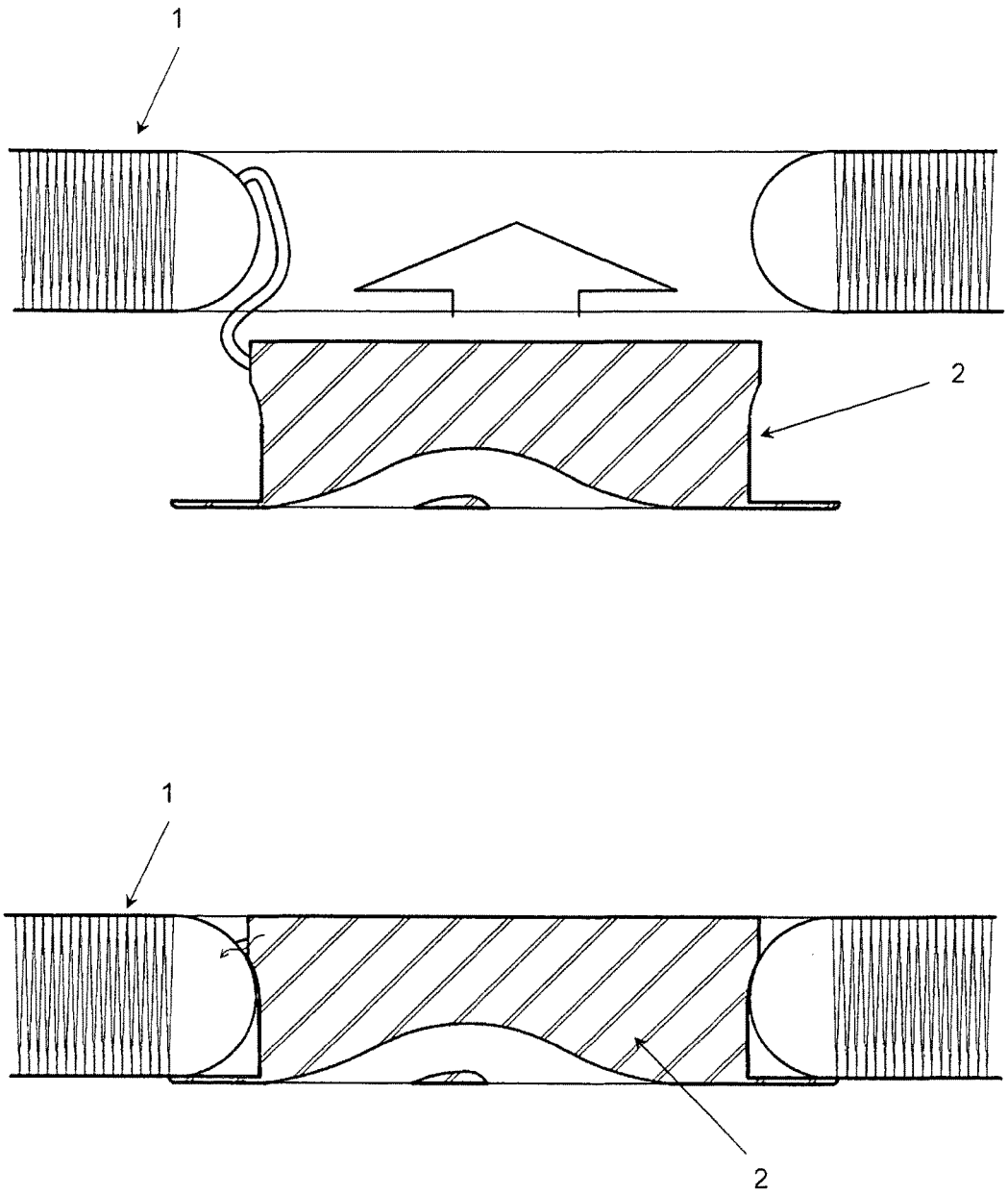
Figure 6:
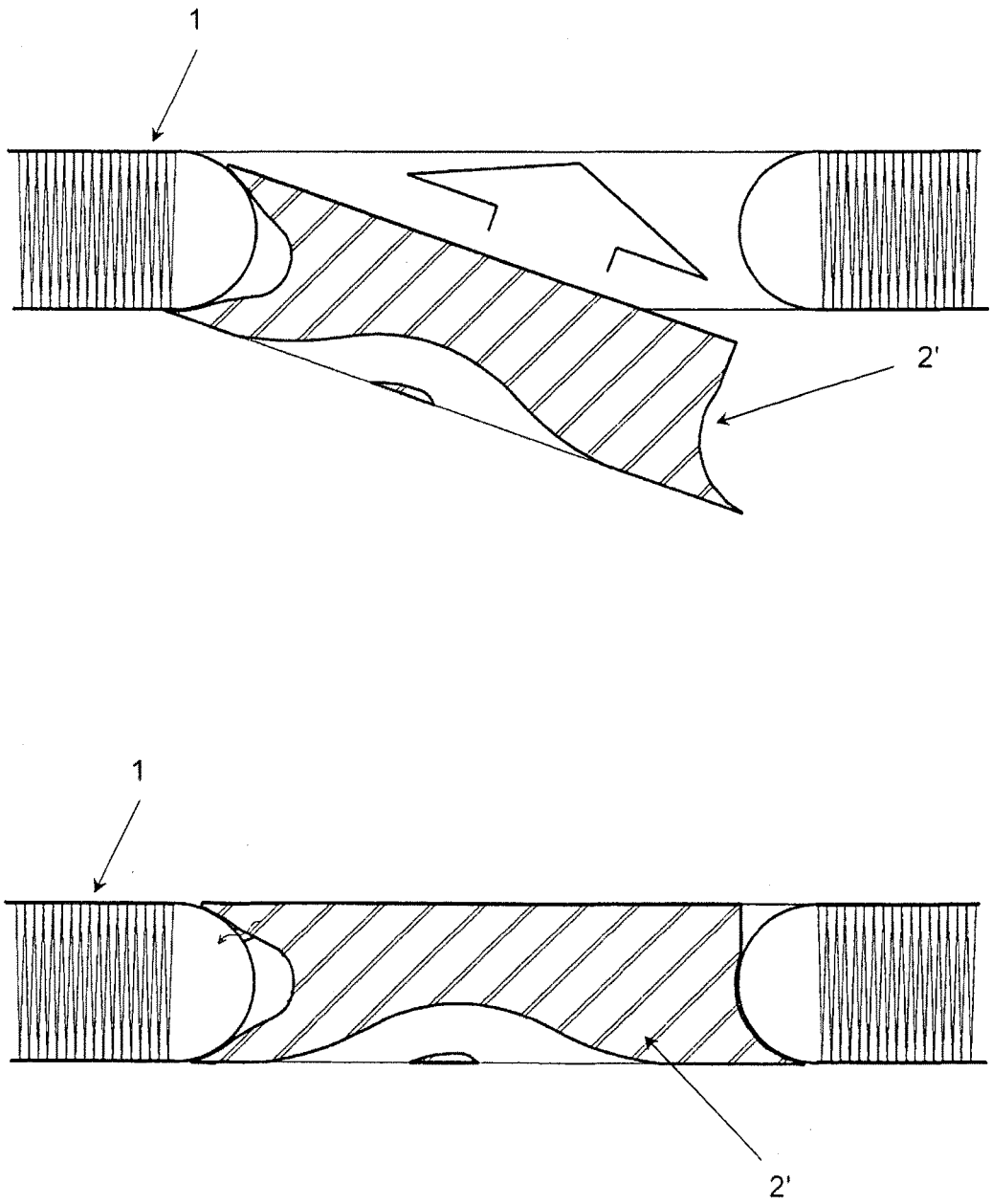
Figure 7:
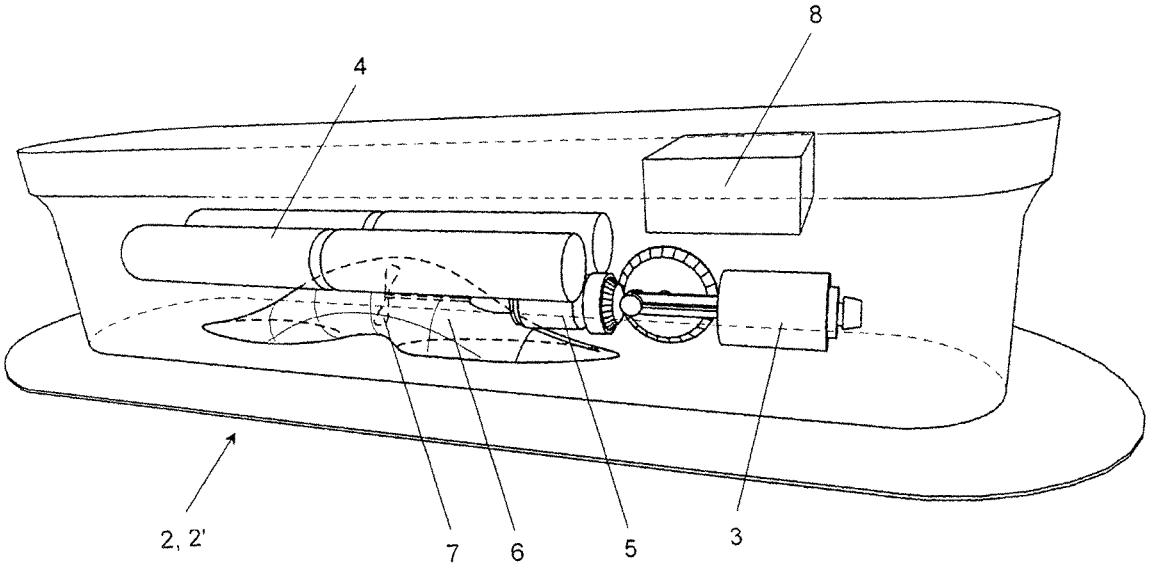
Figure 8:
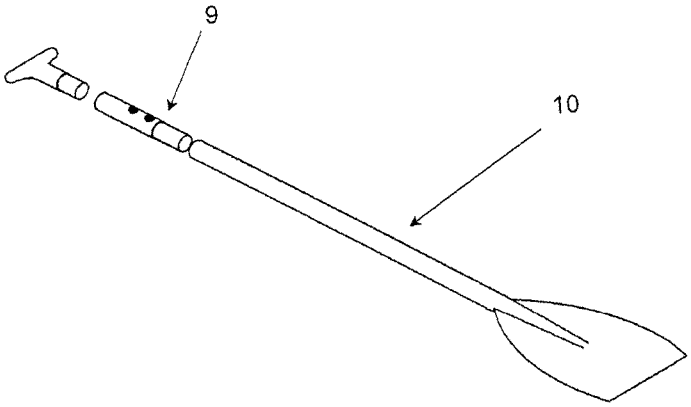

The invention will be explained in more detail by way of an embodiment and the enclosed drawings, representing in:

FIG. 1 top view of an inflatable watercraft of the invention;

FIG. 2 bottom view of the inflatable watercraft of the invention;

FIG. 3 axonometric view of a housing of a drive assembly according to a first embodiment;

FIG. 4 axonometric view of a housing of a drive assembly according to a second embodiment;

FIG. 5 cross-section of the inflatable watercraft of the invention with a presentation of insertion of the housing of the drive assembly according to the first embodiment;

FIG. 6 cross-section of the inflatable watercraft of the invention with a presentation of insertion of the housing of the drive assembly according to the second embodiment;

FIG. 7 axonometric view of the housing of the drive assembly with a presentation of arrangement of the drive assembly containing storage batteries, an electric motor with a propeller and a watercraft inflation system, and electronic circuit;

FIG. 8 oar of the watercraft.

Figure 9:
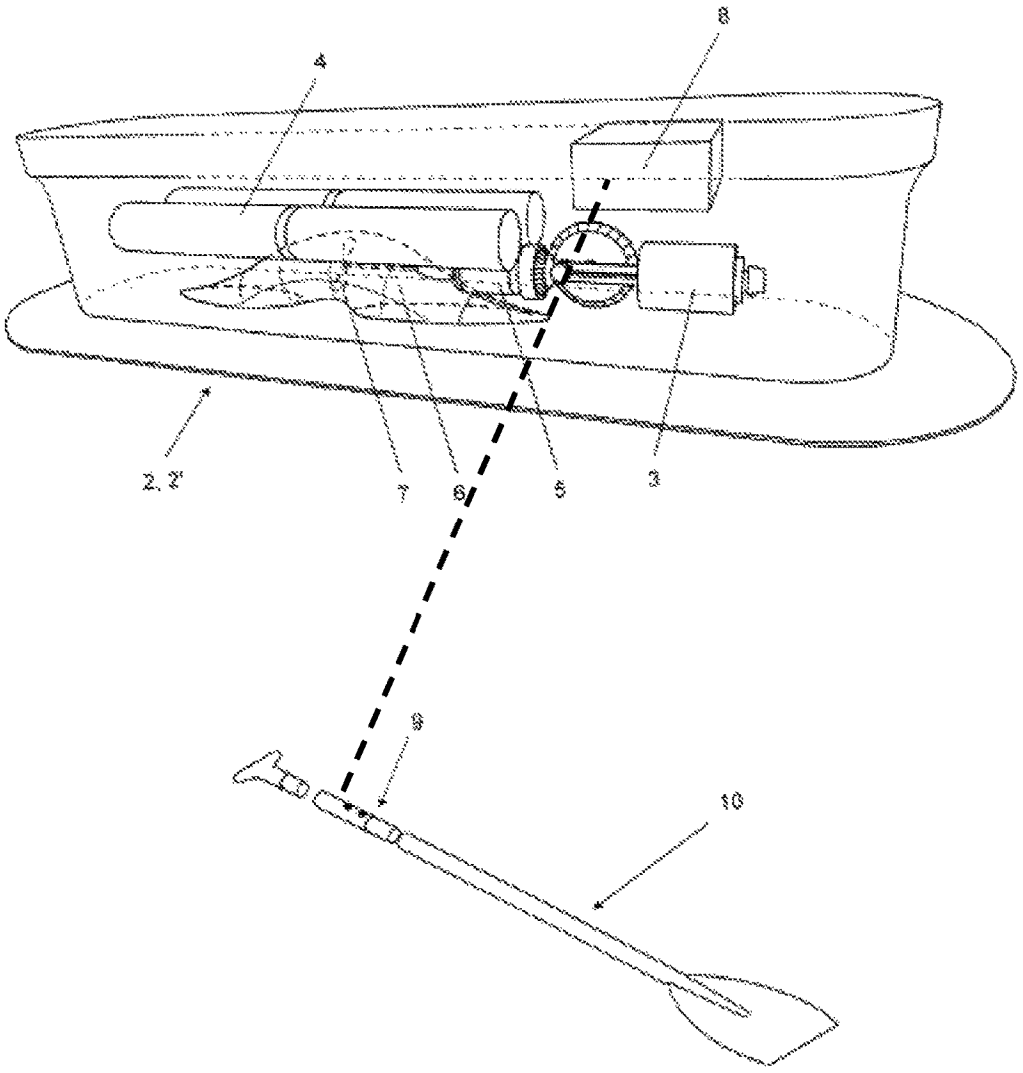

FIG. 9 illustrates the oar of the water craft wirelessly connected to the drive assembly.

Before filling air into an inflatable watercraft 1 a housing 2 or 2' of a drive assembly is inserted into a specially shaped recess in the inflatable watercraft 1. The recess in the inflatable watercraft 1 is formed in the Center of the watercraft, preferably in the center of gravity of the inflatable watercraft, which provides for the fact that the housing 2 or 2' (and herewith the drive assembly accommodated in it) is always in the water during floating; this provides for the best possible water flow through the drive assembly and reduces possibilities of disturbances (drawing of air), which can in fact cause decelerations and accelerations and consequently instability of the inflatable watercraft while floating.

While the inflatable watercraft 1 is filled with air, the air pressure firmly fixes the housing 2 or 2' of the drive assembly in a proper position without any additional tools, screws, glue and the like. The housing 2 or 2' (preferably made of plastics) therefore tightly fits the recess made in the centre, preferably in the centre of gravity of the watercraft 1.

FIG. 5 illustrates a method for inserting the housing 2 into the recess in the inflatable watercraft 1, while FIG. 6 illustrates a method for inserting the housing 2' into the recess in the inflatable watercraft of the invention.

FIG. 3 shows a shape of the housing 2 of the drive assembly according to a first embodiment. The housing 2 of the drive assembly is formed as a hollow body with bases 2*a*, 2*b* in the shape of an elongated ellipse that are mutually connected by a connecting wall 2*c*, said connecting wall extending towards the base 2*a* in a slightly outwards shaped arc. The base 2*b* has preferably larger dimensions than the base 2*a*.

FIG. 4 shows a shape of a housing 2' of a drive assembly according to a second embodiment. The housing 2' of the drive assembly is formed as a hollow body with bases 2*a*', 2*b*' in the shape of an elongated ellipse that are mutually connected by a concave curved connecting wall 2*c*. The vaulted structure of the connecting wall 2*c*' is especially distinctive at both ends of the housing 2' of the drive assembly.

The described shape of the housing 2 or 2' of the drive assembly allows its simple insertion into the recess in the inflatable watercraft 1 and after the inflatable watercraft is completely filled with air, the housing 2 or 2' of the drive assembly is firmly fixed in the recess.

Upon insertion of the housing 2 or 2' of the drive assembly an airtight connection between a compressor 3 and the watercraft 1 is established. Before inflating is performed, a cover on the upper part of the housing 2 or 2' of the drive assembly needs to be opened in order to allow air supply into the compressor 3. An operating device (within an oar 9) is used to turn on filling of the watercraft 1. The filling is automatically discontinued once the desired pressure is reached in the watercraft 1. Once the watercraft 1 is inflated, the air pressure within the watercraft 1 firmly holds the housing 2 or 2' of the drive assembly within the recess. When the filling is completed, the cover is closed and the watercraft 1 is ready for use.

The upper part of the housing 2, 2' is covered by the cover, under which an opening to allow the flow of air into the compressor 3 is arranged. The latter can only operate when the cover is opened. The recess formed in the inflatable watercraft 1 also accommodates a connector for charging storage batteries 4 that are protected against moisture during cruising by the cover. During the use—cruising the opening is tightly closed by the cover. The status of the cover (closed/opened) is detected by a sensor that determines the mode of operation in this way: when the cover is opened only the compressor 3 operates and when the cover is closed, only the drive of the watercraft operates.

The drive assembly inserted into the housing 2 or 2' comprises storage batteries 4 and an electric motor 5 that is used both for driving the watercraft 1 and for operating the compressor 3. The drive assembly is provided with a flow-through channel 6, in which a drive screw 7—propeller is arranged. The drive screw 7 is arranged within the flow-through channel 6 extending in the interior of the drive assembly and therefore having minimum impact on the water flow on the bottom side of the watercraft 1 during oaring. The flow-through channel 6 is protected both on the input and output sides by a grate that prevents a user from contacting the drive screw 7 or intake of large particles into the flow-through channel 6.

One part of the drive assembly is also a watercraft inflation system—a piston compressor 3 with electronic pressure control and an electronic circuit 8 that allows establishment of a wireless connection with an operating device 9 arranged within the oar 10. The operating device 9 operates both the functioning of the electric motor 5 in the inflation mode of the watercraft 1 and the drive during cruising and controls the status of the storage batteries 4 while being in use and while being charged.

The user can use the operating device 9 arranged within the oar 10 during cruising in order to optionally turn the watercraft on/off, set the speed of the watercraft, turn the drive on/off etc. If, while in use, the oar 9 gets too far away from the watercraft and the wireless connection gets disconnected (for instance if the oar falls into the water, loss of the oar), the drive gets automatically disconnected.

FIG. 9 shows a wireless connection between the electronic circuit 8 of the drive assembly and the operating device 9 of the oar.

The control electronic circuit 8 in the drive assembly controls the operation and prevents potential overloads (measures the current, the temperature of the motor and batteries, the voltage of battery members etc.). When detecting unpermitted conditions, it reacts accordingly and transmits an acoustic signal to the user via wireless connection with the operating device 9 arranged within the oar 10. The control electronic circuit 8 can also be used to control the filling status or to prevent overfilling (too high pressure in the inflatable watercraft). This contributes to optimal filling condition and a longer life of the inflatable watercraft.

The disclosed drive of the inflatable watercraft allows weaker oarsmen to oar longer distances or to follow a group of better oarsmen. Apart from saving his energy, the drive allows better stability to the oarsman and this is especially favourable for beginners who find it hard to balance. With the drive turned on, the inflatable watercraft better follows the course.

The inflatable watercraft of the invention is easily transported as the empty watercraft occupies as much space as a conventional inflatable watercraft, whereas the drive assembly is compact enough to be kept in a special pocket on a bag for storing the watercraft. The drive assembly of the inflatable watercraft of the invention is also provided with the compressor 3 and this is why no air pump or a special compressor is needed.

The control electronic circuit 8 can additionally be equipped with a tracking system, GPS and similar devices.

The invention claimed is:

1. An inflatable watercraft comprising:

a housing;

a drive assembly;

a drive;

a recess, wherein the recess extends through the watercraft creating an opening at a top and a bottom and is configured to accommodate the housing for the embedded drive of the drive assembly and formed in a center of the inflatable watercraft;

wherein the housing is formed as a hollow body with a pair of bases (2*a*, 2*b*) in the shape of an elongated ellipse that are mutually connected by a connecting wall (2*c*), the connecting wall extending towards one of the bases (2*a*) in a slightly outwards shaped arc and wherein the one of the bases (2*b*) has larger dimensions than the one one of the bases (2*a*).

2. The inflatable watercraft of claim 1, wherein the housing is formed in a center of gravity of the inflatable watercraft.

3. The inflatable watercraft of claim 2, wherein the drive assembly further comprises:

a flow-through channel having an input side and an output side; and a drive screw.

4. The inflatable watercraft of claim 1, wherein the drive assembly further comprises:

a plurality of storage batteries;

an electric motor, wherein the electric motor is configured to drive the inflatable watercraft;

a compressor; and an electronic circuit.

5. The inflatable watercraft of claim 4, wherein the electronic circuit enables a wireless connection between the drive assembly and an operating device contained with an oar.

6. The inflatable watercraft of claim 5, wherein the operating device is configured to be utilized by a user of the inflatable watercraft to turn the inflatable watercraft on and off, set a speed of the inflatable watercraft, and to turn the drive on and off.

7. The inflatable watercraft of claim 4, wherein the electronic circuit is equipped with a tracking system selecting from the group consisting of: global positioning system (GPS).

8. The inflatable watercraft of claim 4, wherein an upper part of the housing is covered by a cover, under which an opening is located to allow a flow of air into the compressor.

9. The inflatable watercraft of claim 4, wherein the cover is in an open position only the compressor operates, and when the cover is in a closed position only the drive assembly of the inflatable watercraft operates.

10. The inflatable watercraft of claim 4, wherein the electronic circuit is configured to perform the functions selected from the group consisting of: measuring current, measuring the temperature of the motor, measuring the temperature of the batteries, and measuring the voltage of the batteries.

11. The recess of claim 1 wherein the recess is confined to the center of the watercraft.

* * * * *